US006076743A

United States Patent [19]

Fan

[11] Patent Number: 6,076,743

[45] Date of Patent: Jun. 20, 2000

[54] SHOWERHEAD

[75] Inventor: Chen-Yueh Fan, Taipei, Taiwan

[73] Assignee: Tai E International Patent and Law Office, Taipei, Taiwan

[21] Appl. No.: 09/205,059

[22] Filed: Dec. 3, 1998

[51] Int. Cl.[7] ..... B05B 3/04; B05B 1/16

[52] U.S. Cl. ..... 239/99; 239/381; 239/447; 239/449

[58] Field of Search ..... 239/446–450, 239/436, 443, 558, 559, 99, 381

[56] References Cited

U.S. PATENT DOCUMENTS

| | | | |
|---|---|---|---|
| 3,762,648 | 10/1973 | Deines et al. | 239/381 |
| 4,204,646 | 5/1980 | Shames et al. | 239/381 |
| 4,330,089 | 5/1982 | Finkbeiner | 239/381 |
| 4,588,130 | 5/1986 | Trenany | 239/381 |
| 4,629,124 | 12/1986 | Gruber | 239/447 X |
| 5,184,777 | 2/1993 | Magnenat et al. | 239/446 X |
| 5,213,267 | 5/1993 | Heimann et al. | 239/446 |
| 5,433,384 | 7/1995 | Chan et al. | 239/449 |
| 5,707,011 | 1/1998 | Bosio | 239/449 X |

FOREIGN PATENT DOCUMENTS

| | | | |
|---|---|---|---|
| 3900124 | 7/1989 | Germany | 239/448 |

*Primary Examiner*—Kevin Weldon
*Attorney, Agent, or Firm*—Sanford E. Warren, Jr.; Gardere & Wynne, LLP

[57] ABSTRACT

The present invention provides an improved showerhead that can select the type of water steam by a single hand. A movable flapper is mounted in the showerhead, and a button connected to the flapper is pivotally mounted on the outside of the shell of the showerhead. A first outlet is defined on one surface of a water-separating plate and connects with a slant hole of a spacing block, a second outlet is defined on one surface of the water-separating plate and connects with a plurality of holes on the plate. Therefore, the water stream can be force to exit from the first or the second hole by rotating the flapper so that the water stream will exit through the slant hole in the spacing block or the plural holes in the water-separating plate.

4 Claims, 3 Drawing Sheets

SHOWERHEAD

BACKGROUND OF THE INVENTION

1. Field of the Invention

The present invention relates a showerhead, and more particularly to a button mounted on one side of the showerhead to select the desired type of water stream exiting the shower head. The present invention can select either the usual water spray for a shower or a special pulsating water spray to massage a user.

2. Description of the Related Arts

The structure of a conventional showerhead that can select between normal and pulsating sprays is shown in FIG. 6. Water enters the showerhead through an inlet (27). If a user rotates an adjusting rotary button (13) mounted on the top of the showerhead, a disk (24) mounted on the lower end of an adjusting rod (16) connected to the button (13) seals the central outlet (34). An O-ring (36) mounted around a lug (33) forms a seal at the bottom of a cylinder (19) so that water can not exit and is forced to move upward and pass through an outlet (23) to a plurality of circular water-jet holes (32) defined in a cap (30).

When the outlet (23) is sealed by the disk (24) by rotating the adjusting rotary button (13), the water stream is shut off from the water-jet holes (32). The water stream entering the showerhead can directly exit through the circular hole (34), which enables the available showerhead to select either of two different kinds of water stream. As seen in the above description, a user must use two hands to adjust the showerhead, that is, one hand must hold the body of the showerhead, and the other hand rotates the adjusting rotary button (13). So, it is difficult for the user to adjust the showerhead, especially for the user who is taking a shower with a baby held in one arm.

SUMMARY OF THE INVENTION

The main objective of the present invention is providing an improved showerhead that can change the water steam by a single hand. A movable flapper is mounted in the showerhead, and a button connected to the flapper is pivotally mounted on the outside of the shell of the showerhead. A first outlet is defined on one surface of a water-separating plate and connected with a slant hole of a spacing block, and a second outlet is defined on one surface of the water-separating plate and connected with a plurality of holes on the plate. Therefore, the water stream can be force to exit from the first or the second hole by rotating the flapper so that the water stream exits through the slant hole in the spacing block or the plurality of holes in the water-separating plate.

The preferred embodiment of the present invention will be described in detail with the aid of the enclosed drawings.

DESCRIPTION OF THE PREFERRED EMBODIMENT

Figure 1:
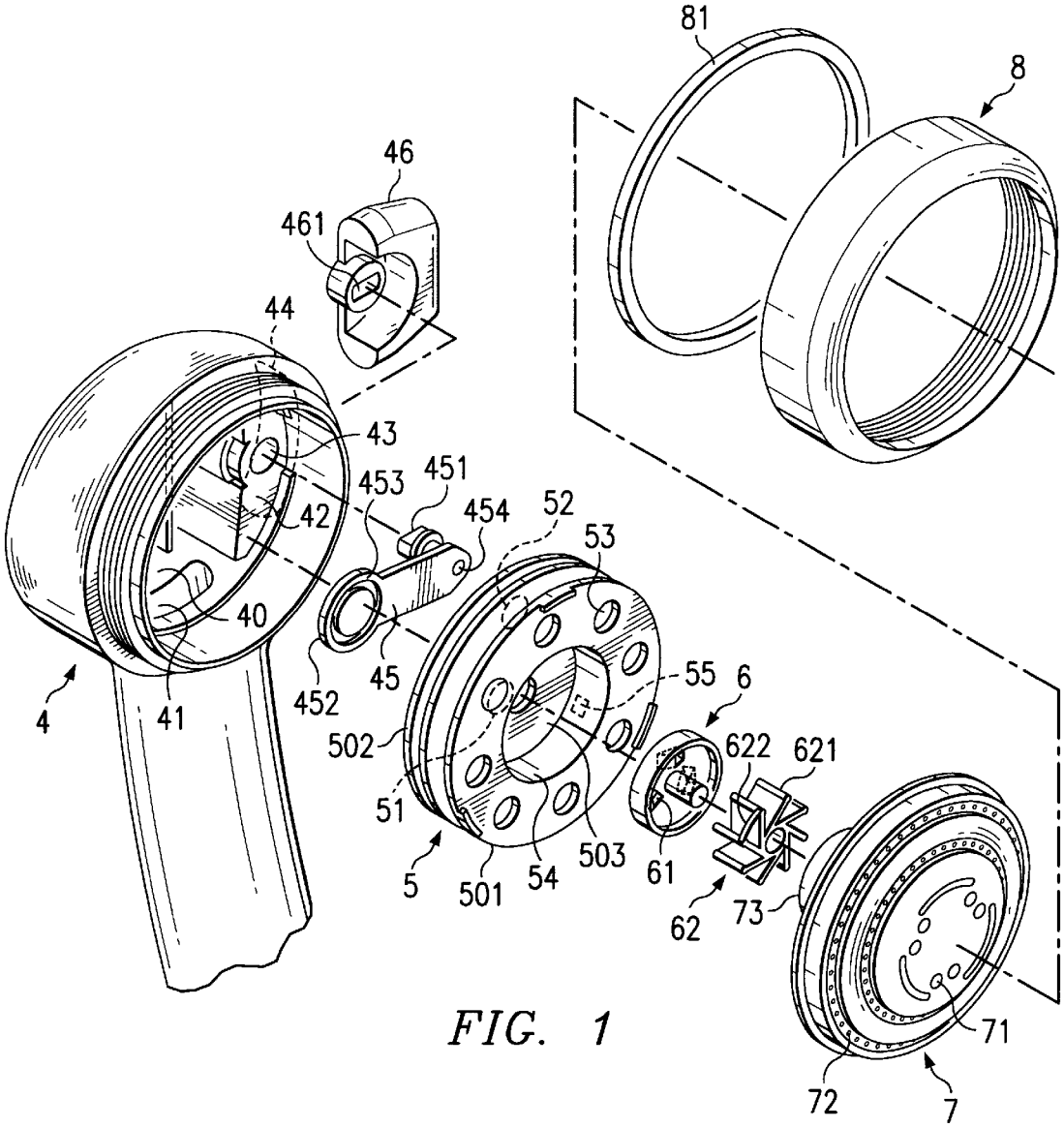
FIG. 1 is an exploded perspective view of the present invention.

Referring to FIG. 1, an improved shower head of the present invention comprises a water-exit element (4) with a cavity (40) defined therein, a pivotally movable flapper (45) held in the cavity (40) of the water-exit element (4), a water-separating plate (5) with a first outlet (51) and a second outlet (52) which is tightly held in the cavity (40) of the water-exit element (4), a spacing block (6) with a plurality of slant holes (61) connected with the first outlet (51), a rotary body (62) with a plurality of blades (621) expanded in slant direction and stop blades (622) set between adjacent blades (621), a nozzle cover (7) with a plurality of third outlets (71) connected with the slant holes (61) in the spacing block (6) and forth outlets (72) connected with the second outlet (52) in the water separating plate (5), and a retaining ring (8) that holds the nozzle cover (7) and water separating plate (5) tightly in the cavity (40) of the water-exit element (4). Wherein, there are a main inlet (41) connected with a water source, a locating seat (42) connected with the cavity (40) and a locating hole (43) defined therein, and a groove (44) located on the side of the water-exit element (4), connected with the locating hole (43) and having a button (46) pivotally mounted therein. An elongated recess (461) is defined in the button (46) that is pivotally held in the groove (44). The flapper (45) substantially is "L" shape. Its first end (451) is inserted into the elongated recess (461) in the button (46) through the locating hole (43) in the locating seat (42) to form a waterproof seal and the second end (452) has an annular seal packing ring (453) protruding from the surface thereof. Therefore, when the button (46) is rocked, it also makes the flapper (45) move at the same time. The first section (501) and the second section (502) are fastened together at some distance by a bottom plate (503) through which the first outlet (51) passes and is mounted between two sections. A recess (54) is defined between the first section (501) and the bottom plate (503) which is connected to the first outlet (51). The nozzle cover (7) has an extended hollow section (73) whose inner space is connected to the third outlets (71) and can hold the rotary body (62) pivotally mounted therein. The extended hollow section (73) also fastens the spacing block (6) so that the rotary body (62) and the spacing block (6) are tightly sealed in the extended hollow section (73).

When the showerhead is assembled, the button (46) is put into the groove (44) defined in the side of the water-exit element (4). Second, the first end (451) of the flapper (45) is fastened into the elongated recess (461) of the button (46) through the locating hole (43) so that the rocking movement of the button (46) simultaneously makes the flapper (45) pivotally move. Third, the water separating plate (5) is secured in the cavity (40) defined in the water-exit element (4) in a watertight fit. At this time, the boss (55) integrally formed on one side of the water separating plate (5) is inserted into the hole (454) defined in the first end (451) held in the flapper (45) in axial direction. Therefore, the second end (452) of the flapper (45) can move between the first outlet (51) and the second outlet (52), and water in the cavity (40) which comes from the main inlet (41) will exit from the second outlet (52) when the first outlet (51) is sealed by the second end (452) of the flapper (45). When the second outlet (52) is sealed by the second end (452) of the flapper (45), water in the cavity (40) which comes from the main inlet (41) will exit from the first outlet (51).

After the water-exit element (4) and the water separating plate (5) have been assembled as above described, the rotary body (62) and the spacing block (6) are respectively inserted into the extended hollow section (73) defined in the nozzle cover (7), and the spacing block (6) is tightly mounted in the extended hollow section (73) by watertight means so that neither the spacing block (6) nor the rotary body (62) can be separated from the extended hollow section (73). Then, the nozzle cover (7) is placed over the water separating plate (5) and the extended hollow section (73) is mounted in the recess (54) of the water separating plate (5). Therefore, the bottom surface of the nozzle cover (7) is in contact with one side of the separating plate (5). Finally, the retaining ring (8) is tightly screwed onto the water-exit element (4). It is preferred that an "O" shaped gasket (81) is placed around the outer circumference of the water-exit element (4) before the retaining ring (8) screwed onto the water-exit element (4) so that the "O" shaped gasket (81) forms a watertight seal.

Figure 2:
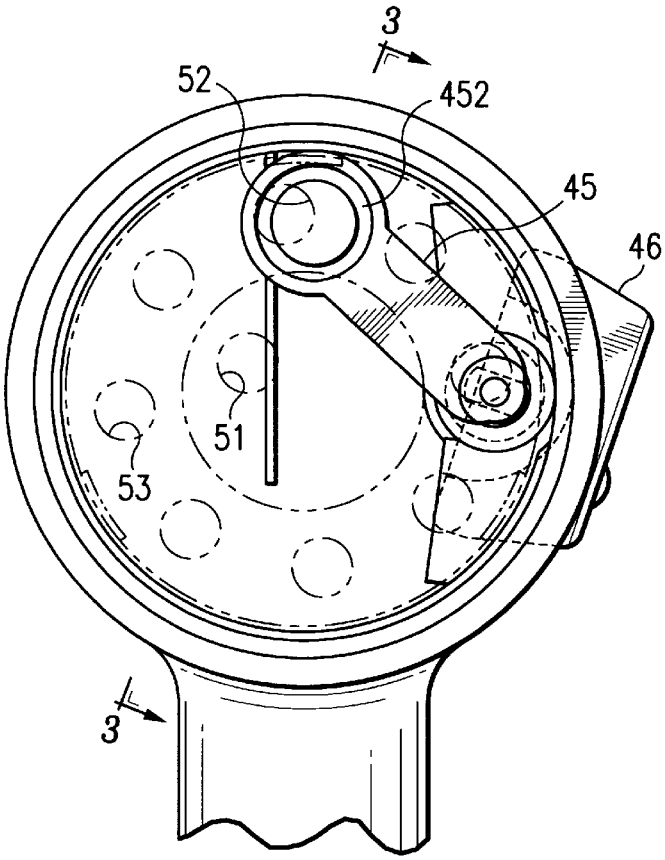
FIG. 2 is a schematic top plan view of the present invention when the flapper is at the first position.
Figure 3:
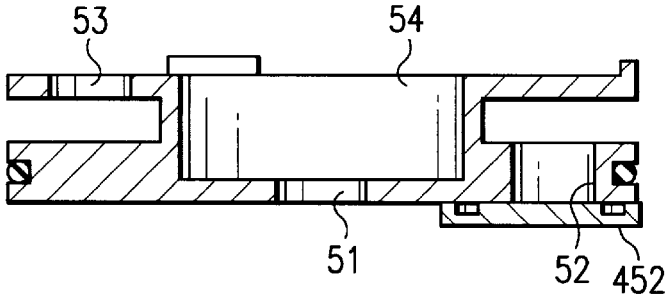
FIG. 3 is a cross-sectional view of the present invention according to the line 3—3 in FIG. 2.

Referring to FIGS. 1, 2 and 3, when the second outlet (52) is sealed by controlling the position of the button (46) (or flapper (45)), water in the cavity (40) which come from the main inlet (41) will exit from the first outlet (51). As the first outlet (51) is connected to the slant hole (61) defined in the spacing block and the third outlet (71) defined in the nozzle cover (70), the water stream first enters the extended hollow section (73) through the slant hole (61). Moreover, the water stream entering the extended hollow section (73) makes the blades (621) of the rotary body (62) rotate because there is a angle between the direction of the water stream and the perpendicular direction. At this time, the stop blade (622) set between two adjacent blades (621) successively seals one of the plurality of slant holes (61). A pulsating water stream is formed as the water stream exits the third outlet (71) because of the stop blade (622) so that a message effect is achieved.

Figure 4:
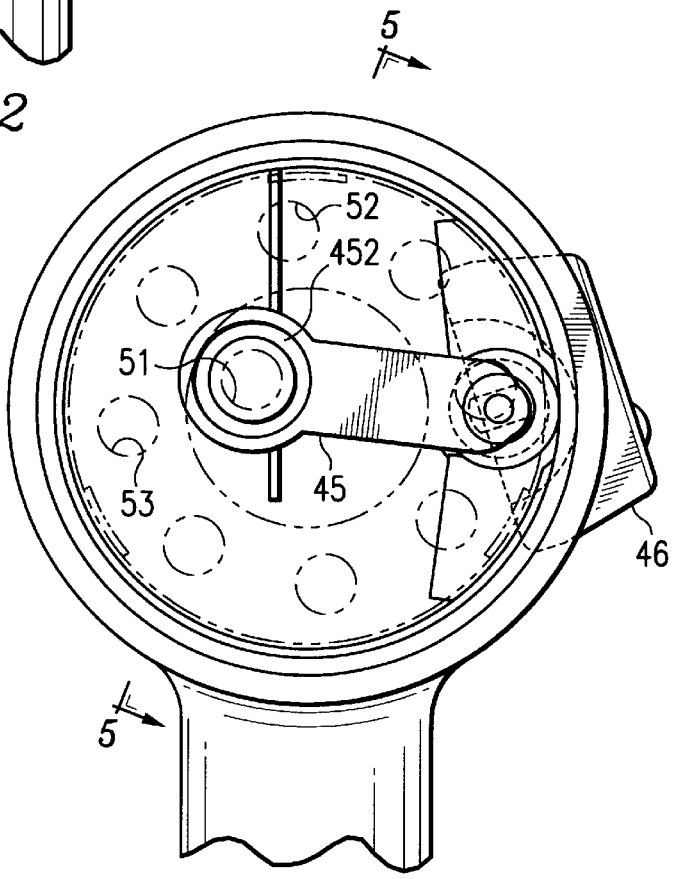
FIG. 4 is a schematic top plan view of the present invention when the flapper is at the second position.
Figure 5:
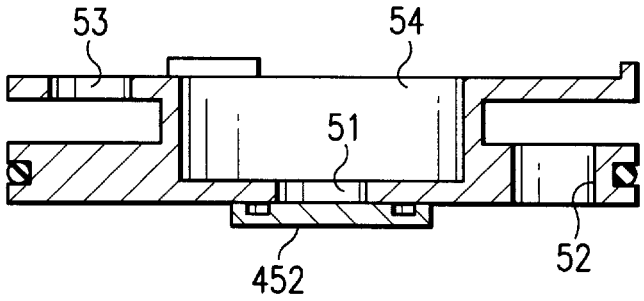
FIG. 5 is a cross-sectional view of the present invention according to the line 5—5 in FIG. 4.
Figure 6:
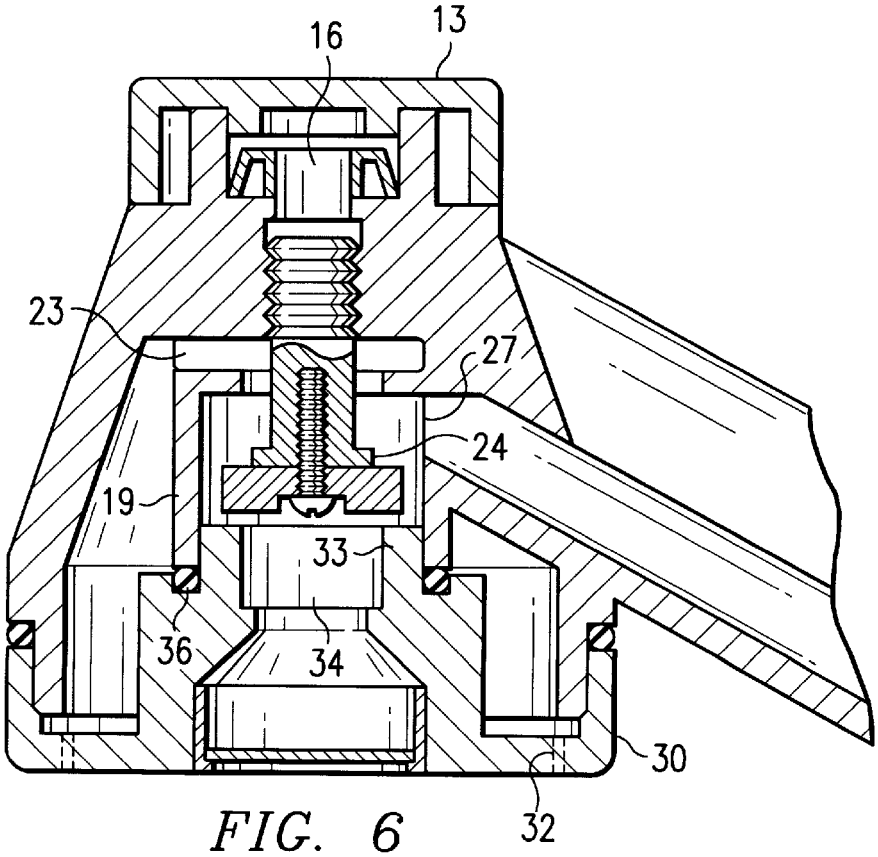
FIG. 6 (PRIOR ART)
FIG. 6 is a partial cross-sectional view of a conventional adjustable showerhead.

Referring to FIGS. 4 and 5, when the first outlet (51) is sealed by the second end (452) of the flapper (45), water in the cavity (40) which comes from the main inlet (41) will exit from the second outlet (52). As the second outlet (52) is connected to the plurality of holes (53) defined in the first section (501), and the holes (53) are connected to the forth outlets (70) defined in the nozzle cover (7), the water stream in the cavity (40) exits directly from the forth outlets (72) and out of the nozzle cover (7). Thereby, a normal shower effect is achieved.

The showerhead of the present invention can be adjusted by a single hand and has many advantages such as easy operation, simple structure and easy maintenance.

What is claimed is:

1. An improved shower head comprises:

a water-exit element having a cavity defined therein and a main inlet connected to the water source;

a locating seat mounted in the cavity and having a locating hole defined therein;

a groove formed on one side of the showerhead water exit element and communicating with the locating hole;

a button pivotally positioned in the groove and having an elongated recess defined therein;

a water separating plate secured in the cavity with a watertight fit and having a recess defined therein;

a first outlet defined in the bottom surface of the recess and communicating with the cavity and a second outlet which also communicates with the cavity;

a flapper pivotally positioned in the locating hole and fastened together with the button with a watertight fit which has a hole defined therein and an annular packing ring protruding from the surface thereof, wherein, the flapper can seal the first or second outlet based on the choice of a user;

a nozzle cover having a plurality of third and forth holes and an extended hollow section, wherein, the extended hollow section communicates with the third outlets and the first outlet of the water separating plate, and the forth outlets communicate with the second outlet of the water separating plate;

a rotary body pivotally mounted in the extended section of the nozzle cover and having a plurality of radial blades extending in a slant direction;

a spacing block fastened tightly into the extended hollow section and sealing the rotary body therein and having a plurality of slant holes communicating with the first outlet; and a retaining ring fastening the nozzle cover and the separating plate into the cavity of the water-exit element with a watertight fit.

2. An improved showerhead according to claim 1 having an "O"shaped gasket positioned between the retaining ring and the water-exit element.

3. An improved showerhead according to claim 1, wherein, the rotary body has a stop blade positioned between two adjacent blades.

4. An improved showerhead according to claim 1, wherein, the flapper has a hole, and the water separating plate has a boss that corresponds to and can be inserted into the hole of the flapper.

* * * * *

UNITED STATES PATENT AND TRADEMARK OFFICE

CERTIFICATE OF CORRECTION

PATENT NO. : 6,076,743
DATED : June 20, 2000
INVENTOR(S) : Chen-Yueh Fan

It is certified that error appears in the above-identified patent and that said Letters Patent is hereby corrected as shown below:

1. There is no Assignee for this Patent; and

2. The inventor's name should be Chen-Yueh FAN.

Signed and Sealed this

Twenty-eighth Day of August, 2001

*Attest:*

Nicholas P. Godici

NICHOLAS P. GODICI

*Attesting Officer*

*Acting Director of the United States Patent and Trademark Office*